US012180728B2

(12) United States Patent
Gantt

(10) Patent No.: US 12,180,728 B2
(45) Date of Patent: Dec. 31, 2024

(54) RETAINER MEMBER FOR A BRACE SYSTEM AND METHOD OF FORMING

(71) Applicant: Independence Materials Group, LLC, Virginia Beach, VA (US)

(72) Inventor: William A. Gantt, Blair, SC (US)

(73) Assignee: Independence Materials Group, LLC, Virginia Beach, VA (US)

( * ) Notice: Subject to any disclaimer, the term of this patent is extended or adjusted under 35 U.S.C. 154(b) by 19 days.

(21) Appl. No.: 17/576,069

(22) Filed: Jan. 14, 2022

(65) Prior Publication Data

US 2023/0228110 A1 Jul. 20, 2023

(51) Int. Cl.

| | |
|---|---|
| ***E04G 21/16*** | (2006.01) |
| ***E04G 21/26*** | (2006.01) |
| ***E04G 23/02*** | (2006.01) |

(52) U.S. Cl.

CPC ..... *E04G 23/0229* (2013.01); *E04G 21/163* (2013.01); *E04G 21/26* (2013.01)

(58) Field of Classification Search

CPC ... E04G 21/163; E04G 21/26; E04G 23/0218; E04G 23/0229; E04G 23/04; E02D 31/10

See application file for complete search history.

(56) References Cited

U.S. PATENT DOCUMENTS

| | | | | |
|---|---|---|---|---|
| 587,274 A | | 7/1897 | Ross | |
| 2,511,584 A | * | 6/1950 | Hill | E04G 11/10 249/34 |
| 2,850,254 A | | 9/1958 | Houseworth | |
| 3,030,061 A | | 4/1962 | Jennings | |
| 3,171,627 A | * | 3/1965 | Tapley | B63B 25/24 410/151 |
| 3,204,910 A | * | 9/1965 | Gacher | B63C 5/02 269/74 |

(Continued)

FOREIGN PATENT DOCUMENTS

| | | |
|---|---|---|
| CN | 2749989 U | 1/2006 |
| CN | 103291117 A | 9/2013 |

(Continued)

OTHER PUBLICATIONS

Deep Excavation LLC, Support Systems for Deep Excavations: Cross-lot/Internal Bracing—Braced Excavations, http://www.deepexcavation.com/en/braced-excavations-struts-crosslot, accessed Aug. 9, 2017, 6 pages.

*Primary Examiner* — Ryan D Kwiecinski

(74) *Attorney, Agent, or Firm* — Moore & Van Allen PLLC; Jeffrey R. Gray

(57) ABSTRACT

A wall brace system and/or a retainer member thereof that supports a structural member of the wall brace system, as well as a method of forming the retainer member. In particular, the retainer member includes tabs formed from the body of the retainer member. For example, the tabs may be formed from the edges of the retainer body or from within the edges of the retainer body. When installed, the wall brace system with the retainer member provides an apparatus for supporting a wall in a building structure, which has been moved inward by pressure from the earth outside in order to return the wall to a desired position. The wall brace system comprises a structural member, the retainer member, a mounting member, a load member, a jack, and/or a locking member.

19 Claims, 9 Drawing Sheets

(56) References Cited

U.S. PATENT DOCUMENTS 3,606,231 A * 9/1971 Kilborn ..... B61D 45/005 52/301
3,732,660 A * 5/1973 Byssing ..... E04B 2/7863 52/489.1
3,796,055 A 3/1974 Mahony
3,817,006 A * 6/1974 Williams ..... E04G 21/26 248/354.3
3,971,179 A 7/1976 Bodocsi et al.
4,068,427 A * 1/1978 Camardo ..... E04G 21/26 52/749.1
4,070,833 A * 1/1978 Hancock ..... E04G 21/26 52/149
4,073,108 A * 2/1978 Williams ..... E04B 2/825 52/262
4,189,891 A 2/1980 Johnson et al.
4,353,194 A 10/1982 Norton
4,452,028 A 6/1984 Norton et al.
4,453,863 A 6/1984 Sutton et al.
4,757,651 A 7/1988 Crites
4,763,878 A 8/1988 Abraham et al.
4,893,784 A * 1/1990 Abraham ..... E02D 37/00 254/100
5,011,336 A 4/1991 Hamilton et al.
5,013,190 A 5/1991 Green
5,575,591 A 11/1996 Vanderklaauw
5,800,094 A 9/1998 Jones
5,829,220 A 11/1998 Zumeta
5,845,450 A * 12/1998 Larsen ..... E02D 35/00 248/354.3
6,029,407 A * 2/2000 Schillero, Jr. ..... E04G 21/26 52/DIG. 1
6,142,710 A 11/2000 Holland, Jr. et al.
6,247,273 B1 * 6/2001 Nickel ..... E04G 21/26 248/240.2
6,352,390 B1 3/2002 Jones
6,357,190 B1 3/2002 Florentine
6,536,181 B1 * 3/2003 Hong ..... E02D 29/02 52/741.11
6,539,677 B1 * 4/2003 Lanka ..... E04G 21/26 248/354.3
6,655,098 B2 * 12/2003 Dillen, II ..... E04F 21/26 52/182
6,659,692 B1 12/2003 May
6,662,505 B2 12/2003 Heady et al.
6,752,570 B2 * 6/2004 Lanka ..... E04G 21/26 52/127.2
6,769,222 B2 8/2004 Billante
6,854,222 B2 * 2/2005 Hansort ..... E04G 21/26 403/258
7,040,059 B2 * 5/2006 Hodsdon ..... E04G 21/26 254/128
7,178,305 B2 * 2/2007 Petrova ..... F16B 15/0046 52/715
7,380,372 B2 * 6/2008 Resch ..... E04G 23/0218 52/150
7,419,335 B1 * 9/2008 Cohen ..... E04G 23/0229 52/223.13
7,617,640 B2 * 11/2009 Bradley ..... E04G 17/002 52/127.2
7,681,361 B1 * 3/2010 Jendusa ..... E04G 23/0218 52/696
7,681,367 B2 * 3/2010 Morton ..... E02D 37/00 52/514
7,735,268 B1 6/2010 Zidar et al.
7,774,995 B1 * 8/2010 Zidar, Jr. ..... E04G 23/0218 52/715
7,788,859 B2 9/2010 Trotter
7,861,469 B2 * 1/2011 Heady ..... E02D 37/00 52/150
8,136,317 B1 * 3/2012 McCown ..... E04G 23/0229 52/514
8,590,259 B2 * 11/2013 Trinko ..... E02D 17/04 405/230
8,925,267 B1 1/2015 Kirby
8,978,331 B2 * 3/2015 Bowerman ..... E04B 2/8635 52/649.1
9,028,176 B1 * 5/2015 Malloy ..... E02D 17/083 405/282
9,422,734 B1 * 8/2016 Heady ..... E04G 23/0229
10,669,730 B1 * 6/2020 Taylor ..... E04G 23/0229
10,829,950 B1 * 11/2020 Fried ..... E04G 21/24
10,920,442 B2 * 2/2021 Pezzola ..... E04H 9/06
11,028,580 B2 * 6/2021 Burt ..... E04B 1/003
11,142,920 B2 * 10/2021 Gantt ..... E04G 23/0229
11,519,190 B2 * 12/2022 Christine ..... E04G 23/0229
2002/0062612 A1 5/2002 Heady et al.
2002/0176749 A1 11/2002 Provost
2003/0131555 A1 * 7/2003 Heady ..... E04G 23/0229 52/741.15
2003/0192280 A1 * 10/2003 Billante ..... E02D 35/00 52/741.11
2004/0071511 A1 4/2004 May
2004/0091322 A1 5/2004 May
2005/0144885 A1 7/2005 Nau
2005/0172427 A1 8/2005 Sykes
2005/0204673 A1 9/2005 Reed
2005/0238442 A1 * 10/2005 Queen ..... E04G 23/065 405/230
2006/0080926 A1 * 4/2006 Resch ..... E04G 23/0229 52/474
2006/0179728 A1 * 8/2006 Lang ..... E04G 21/26 52/127.2
2006/0260220 A1 11/2006 Ennis et al.
2007/0175174 A1 * 8/2007 Bruno ..... E04G 21/26 52/745.12
2007/0227082 A1 10/2007 Morton et al.
2008/0053035 A1 * 3/2008 Rosenberg ..... E04B 2/762 52/483.1
2009/0078843 A1 3/2009 Trotter
2009/0245942 A1 10/2009 Hawkins et al.
2012/0204512 A1 8/2012 Trinko et al.
2014/0360106 A1 * 12/2014 Sawyers ..... E04G 23/0229 52/127.2
2017/0159284 A1 * 6/2017 Getz ..... E04B 2/58
2019/0360202 A1 * 11/2019 Burt ..... E04B 5/10
2019/0360221 A1 * 11/2019 Gantt ..... E04G 23/04
2020/0157827 A1 * 5/2020 Taylor ..... E04G 23/0229
2020/0284061 A1 * 9/2020 Pezzola ..... E04G 23/04
2021/0404199 A1 * 12/2021 Gantt ..... E04G 21/26

FOREIGN PATENT DOCUMENTS

CN 113216691 A * 8/2021 ..... E04B 1/98
DE 19707317 A1 * 8/1998 ..... E04B 2/8617
DE 202014002813 U1 * 6/2014 ..... E04G 21/26
GB 543741 A 3/1942
GB 2127083 A * 4/1984 ..... E04B 1/003
GB 2199071 A * 6/1988 ..... E04G 23/0218
GB 2238570 A * 6/1991 ..... E04G 23/0274
WO WO-02095163 A2 * 11/2002 ..... E04G 17/002
WO WO-2007136368 A1 * 11/2007 ..... E04B 2/7457
WO WO-2009039583 A1 * 4/2009 ..... E04G 21/26
WO WO-2015130154 A1 * 9/2015 ..... E04G 13/02

* cited by examiner

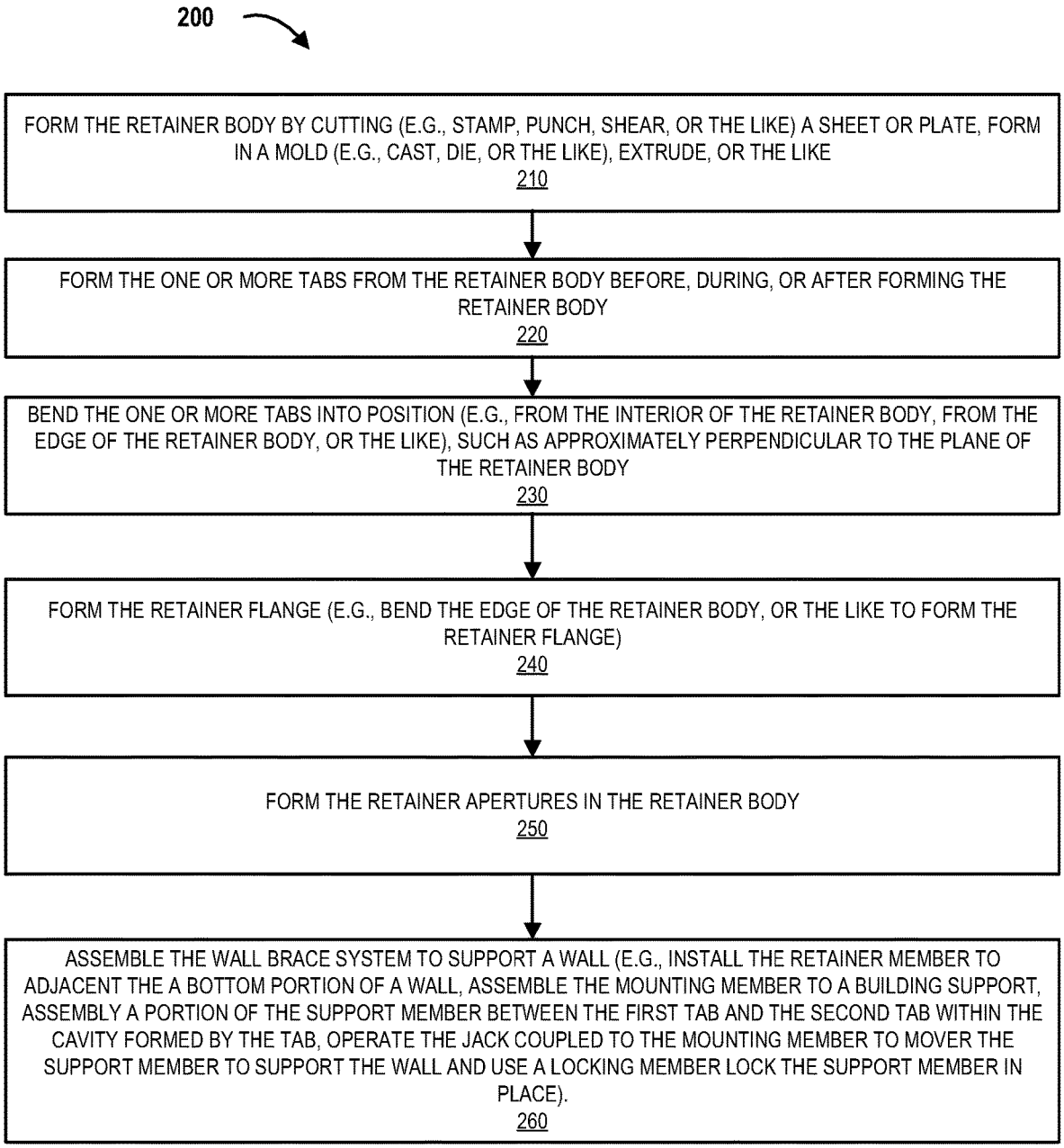
*FIG.* 12

RETAINER MEMBER FOR A BRACE SYSTEM AND METHOD OF FORMING

FIELD

The present disclosure relates to a wall brace system including a retainer member for a structural member and method of forming the retainer member, in particular, a retainer member with tabs formed from the body of the retainer member.

BACKGROUND

A foundation wall, such as a basement wall, is typically constructed of concrete. The concrete can be poured as a solid wall, or individual concrete blocks or bricks can be stacked with mortar placed between the blocks or bricks to form the wall. Since a basement wall is at least partially underground, lateral pressure associated with the surrounding soil and hydrostatic pressure from water in the soil results in horizontally-directed inward force which may cause the wall to deflect inwardly. Sufficient inward deflection will cause a solid concrete wall to fracture or cause cracks to appear along mortar joints on the inner surface of a block wall forced inwardly. Additionally, such inwardly directed forces can move rows of blocks or the entire wall. If such deflection continues unabated, the entire wall may buckle and collapse with likely damage to the supported structure.

A number of methods are available for straightening and reinforcing a foundation wall experiencing deflection. Conventionally, a structural member, such as a steel I-beam, is placed vertically against an interior surface of the wall, such as a leaning or bowed foundation wall. The structural member is braced against other structural members of the building, such as the concrete floor at the base of the wall and a floor joist at the top of the wall. A threaded rod extends horizontally from a secure mounting position for engaging the structural member. The threaded rod is manually turned such that the end of the rod engaging the structural member pushes the structural member and the wall back toward a vertical position. The structural member is then typically left in place to resist the lateral forces.

BRIEF SUMMARY

Embodiments of the invention relate to wall brace systems and/or a retainer member thereof that supports a structural member of the wall brace systems, as well as a method of forming the retainer member. In particular, the retainer member includes tabs formed from the body of the retainer member. For example, the tabs may be formed from the edges of the retainer body or from within the edges of the retainer body. When installed, the wall brace system with the retainer member provides an apparatus for supporting a wall in a building structure, which has been moved inward by pressure from the earth outside in order to return the wall to a desired position. The wall brace system comprises a structural member, the retainer member, a mounting member, a load member, a jack, and/or a locking member. The structural member can be any type of beam of any shape. The structural member is configured to be seated vertically against the inner surface of the wall where pressure can be directed through the structural member toward the wall. The retainer member (otherwise described as a "retainer") may be operatively coupled adjacent the wall, and a portion of the structural member may be operatively coupled to the retainer member. The mounting member is configured to be operatively coupled to a building member. A jack and/or locking member are operatively coupled between the structural member (e.g., directly or through the use of a load member) and the mounting member. The jack functions to exert a force against the structural member, directly or through the load member, in order to force the structural member toward the wall for shifting the wall (e.g., outwardly). The locking member, which may be a fastener, functions to lock the structural member in place with respect to the mounting member after the jack positions the structural member. Thereafter, the jack is removed from the mounting member and may be used on other wall brace systems.

One embodiment of the invention comprises a retainer member. The retainer member comprises a retainer body having at least a body plane. The retainer member has a first retainer tab formed from the retainer body, and a second retainer tab formed from the retainer body. The first retainer tab and the second retainer tab extend away from the body plane and form a cavity. The first retainer tab and the second retainer tab are configured to receive a portion of a structural member in the cavity to aid in restricting movement of the structural member.

In further embodiments, the first retainer tab and the second retainer tab are cut and bent to extend away from the body plane during a single process.

In other embodiments, the retainer body is cut to form the first retainer tab and the second retainer tab within the retainer body plane and thereafter bent to extend the first retainer tab and second retainer tab away from the retainer body In still other embodiments, the retainer body or at least one of the first retainer tab and the second retainer tab comprise an aperture to allow a tool to bend the first retainer tab and the second retainer tab.

In yet other embodiments, the retainer member further comprises a retainer stop that is configured to restrict movement of the structural member within the cavity.

In other embodiments, wherein the retainer stop is a retainer flange formed from an edge of the retainer body, and extending away from the body plane.

In further embodiments, the retainer body, the first retainer tab, and the second retainer tab are made from a unitary piece of material.

In other embodiments, the first retainer tab and the second retainer tab are formed from an outer edge of the retainer body.

In still other embodiments, the first retainer tab and the second retainer tab are formed from within outer edges of the retainer body.

Other embodiments of the invention comprise a wall bracing system. The wall bracing system comprises a retainer member that is operatively coupled adjacent to a wall. The retainer member comprises a retainer body having at least a body plane. The retainer member further comprises a first retainer tab formed from the retainer body and a second retainer tab formed from the retainer body. The first retainer tab and the second retainer tab extend away from the body plane and form a cavity. The wall bracing system further comprises a mounting member operatively coupled to a building member, a structural member, and a locking member. The structural member has a first end and a second end. The first end is operatively coupled to the retainer member within the cavity between the first retainer tab and the second retainer tab and the second end is operatively coupled to the mounting member. The locking member is operatively coupled to the mounting member and is configured to resist movement of the structural member.

In further embodiments, the wall brace system further comprises a jack configured to be operatively coupled to the mounting member and at least a portion of the jack is removable while the locking member remains operatively coupled to the mounting member and the structural member.

In other embodiments, the jack is a hydraulic jack, pneumatic jack, or electric jack.

In still other embodiments, the wall brace system further comprises a load member operatively coupled between the structural member and the locking member.

In yet other embodiments, the mounting member comprise a mounting assembly. The mounting assembly comprises a base plate that is operatively coupled to the building member, and one or more support brackets operatively coupled to the base plate. The one or more support brackets are configured for operative coupling with the jack or the locking member.

In other embodiments, the first retainer tab and the second retainer tab are cut and bent to extend away from the body plane.

In further embodiments, the retainer member further comprises a retainer stop that is configured to restrict movement of the structural member within the cavity.

In other embodiments, the retainer body, the first retainer tab, and the second retainer tab are made from a unitary piece of material.

In still other embodiments, the first retainer tab and the second retainer tab are formed from an outer edge of the retainer body.

In yet other embodiments, the first retainer tab and the second retainer tab are formed from within outer edges of the retainer body.

Other embodiments of the invention comprise a method for forming a retaining member. The method comprises forming a first retainer tab and a second retainer tab from a retainer body. The method further comprises bending the first retainer tab and the second retainer tab such that the first retainer tab and the second retainer tab extend away from a body plane of the retainer body. The first retainer tab and the second retainer tab forms a cavity that is configured to receive a portion of a structural member of a wall brace system between the first retainer tab and the second retainer tab.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE DRAWINGS

For a more complete understanding of the present invention, reference should now be had to the embodiments shown in the accompanying drawings and described below. In the drawings:

FIG. 12 is a process flow for forming the retainer member and installing the wall brace system with the retainer member.

DESCRIPTION

Embodiments of the present disclosure now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Figure 3:
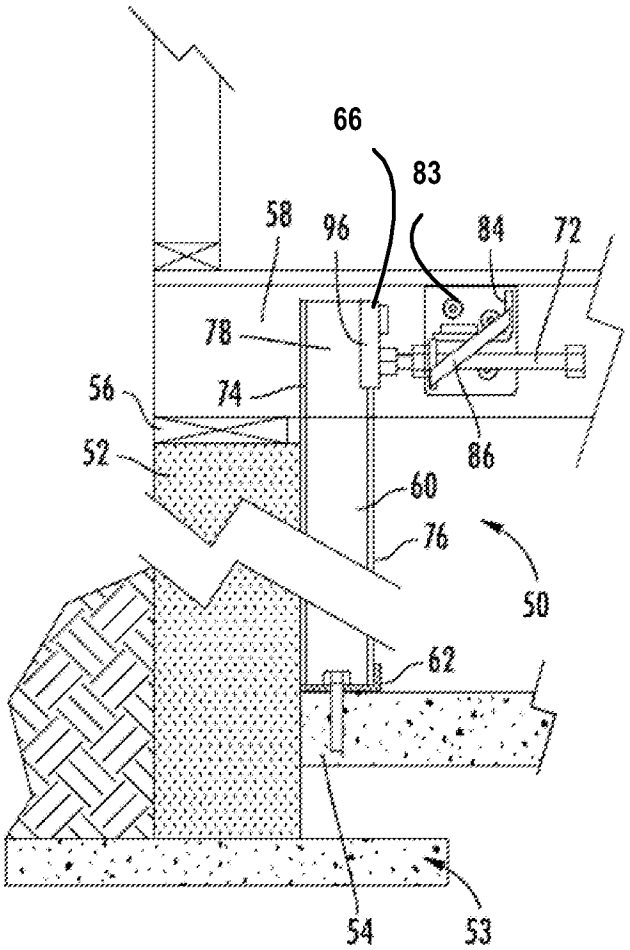
FIG. 3 is a side elevation cut-away view of the wall brace system in position against a wall as shown in FIG. 1 with a jack removed.
Figure 2:
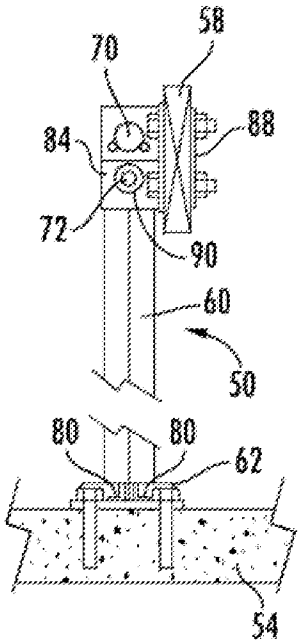
FIG. 2 is a front elevation cut-away view of the wall brace system in position against a wall as shown in FIG. 1.
Figure 1:
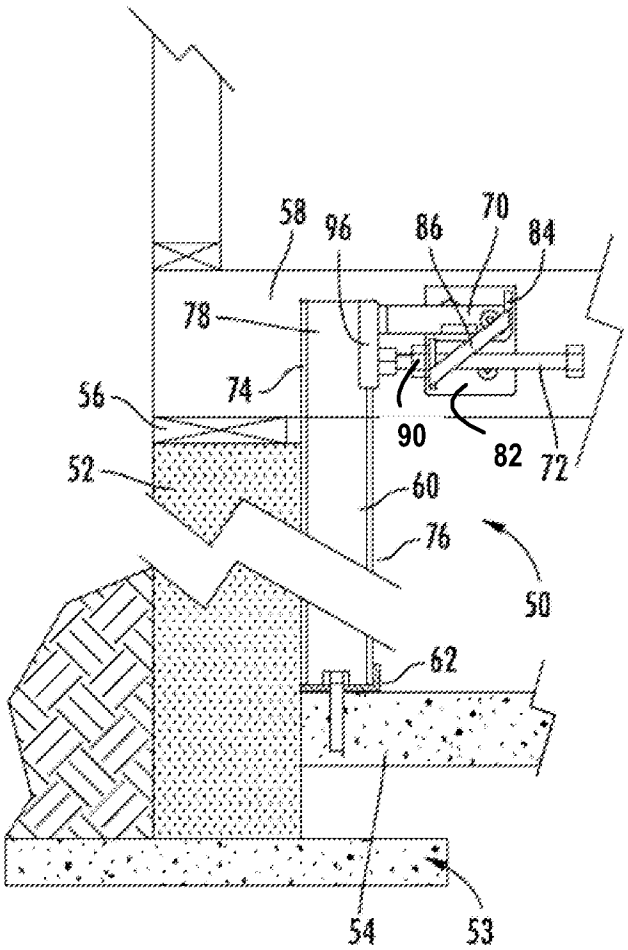
FIG. 1 is a side elevation cut-away view of a wall brace system in position against a wall between a floor and a joist, in accordance with some embodiments of the present disclosure.

Referring now to the drawings, a wall brace system is shown in FIGS. 1-3 and generally designated at 50 in accordance with some embodiments of the present disclosure. A solid concrete wall 52 is also shown, but the particular material of the wall 52 is irrelevant and could include concrete blocks, wood, composites, bricks, any other suitable material, and/or combinations thereof. A floor 54, such as a basement floor, may be operatively coupled to (e.g., intersects, or the like) the wall 52 or other surface (e.g., a foundation 53, or the like) on which the wall 52 rests. The floor 54 and/or other surface (e.g., a foundation 53, or the like) may also be constructed of poured concrete, but again the material is irrelevant and could made of any suitable material or combinations of materials. Atop the wall 52 may be a sill plate 56 on which rests a plurality of structural building members, such as floor joists 58, one of which is shown in FIGS. 1-3. Although not shown, it should be understood that the wall brace system 50 is used when the wall 52 has sustained some form of lateral damage, such as inward bowing, tilting or horizontal shear, or it is anticipated that the wall 52 may sustain such damage in the future.

Figure 4:
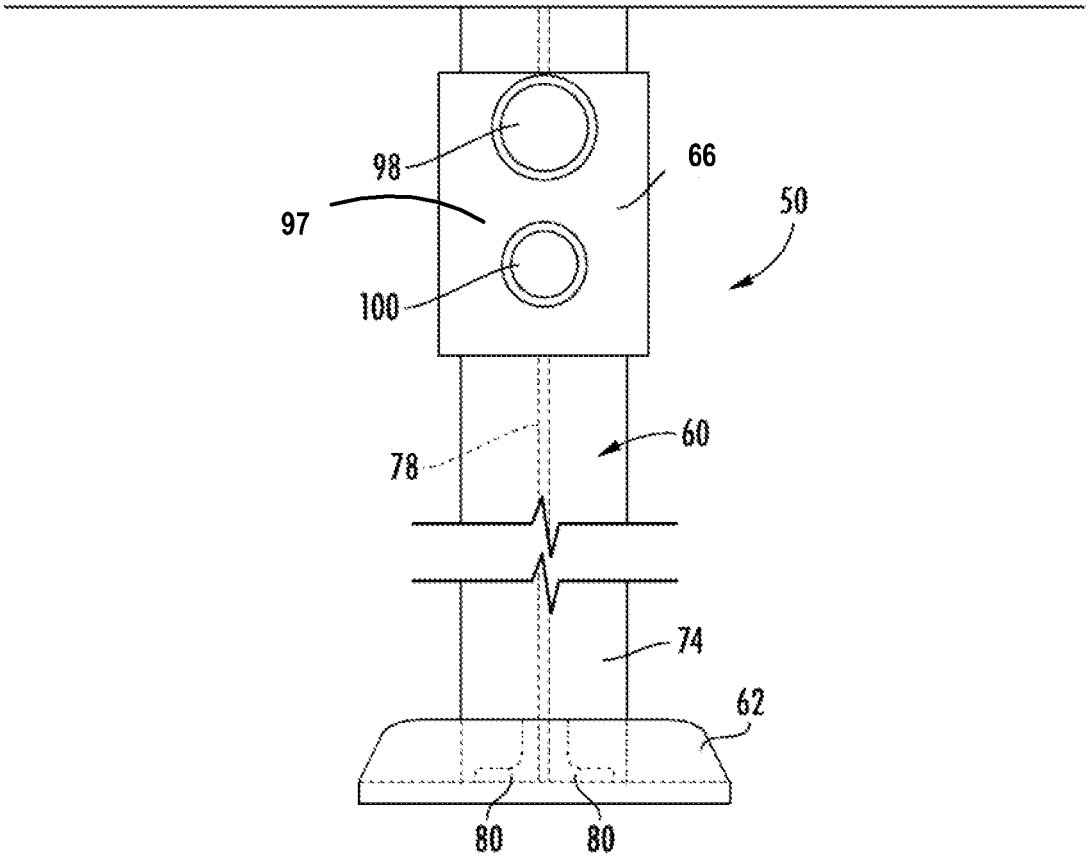
FIG. 4 is a schematic front elevation cut-away view of a portion of a wall brace system as shown in FIG. 1 including a structural member, a retainer member, and a load member.
Figure 5A:
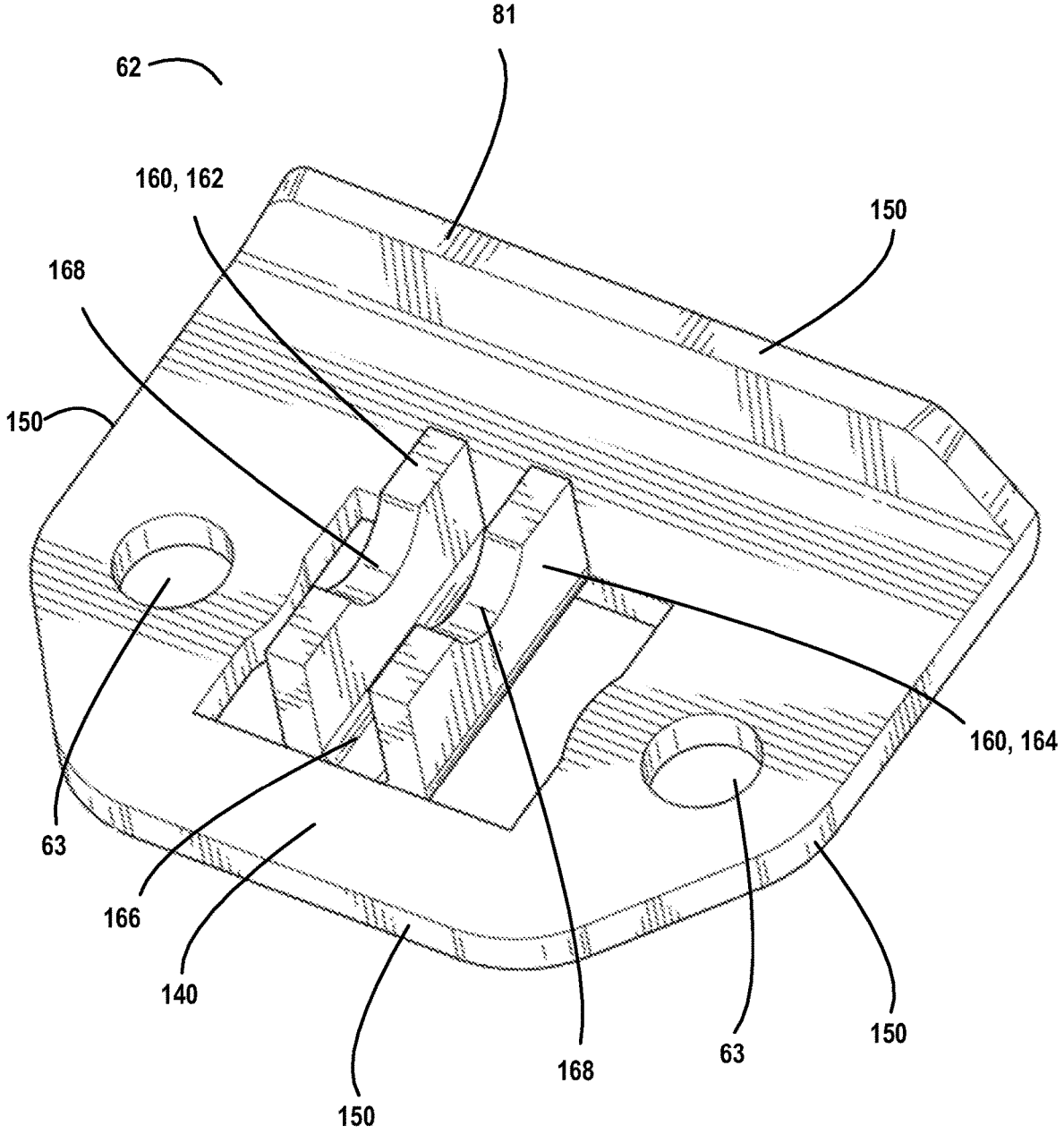
FIG. 5A is a perspective view of a retainer member with tabs formed from the retainer body, in accordance with some embodiments of the present disclosure.
Figure 5B:
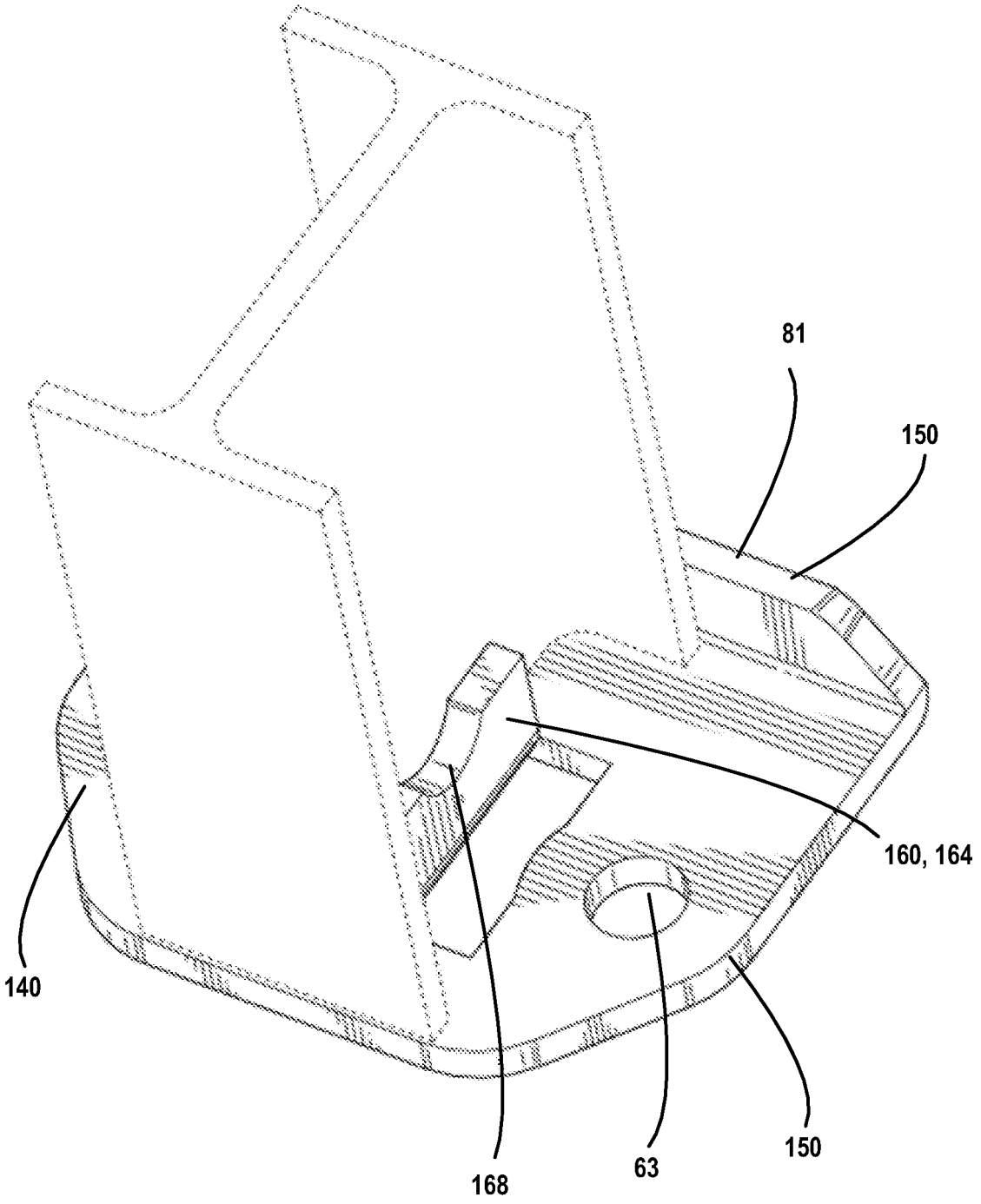
FIG. 5B is a perspective view of the retainer member of FIG. 5A with a structural member installed.
Figure 6:
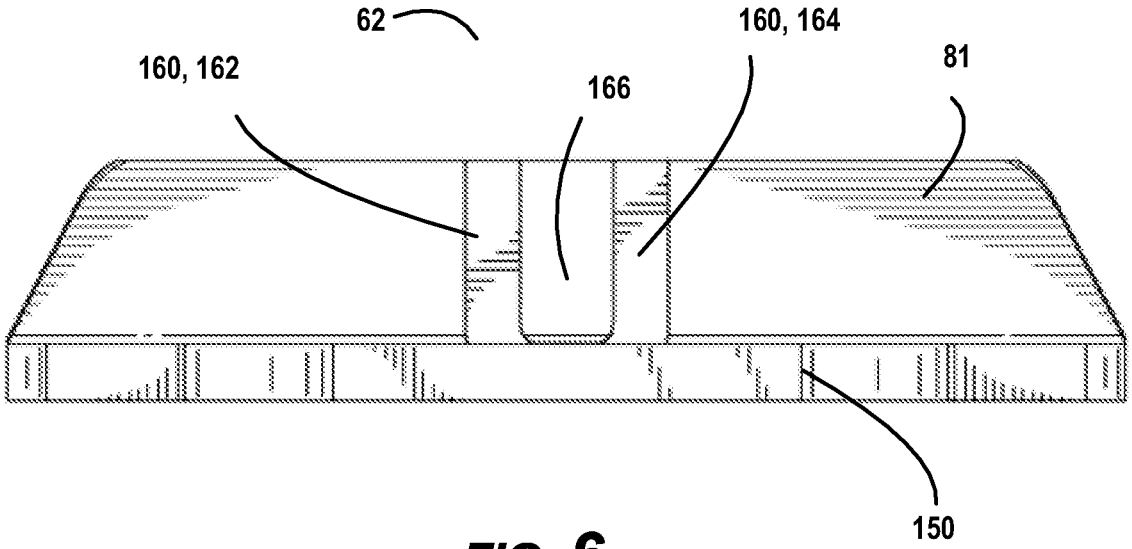
FIG. 6 is front view of the retainer member of FIG. 5A.
Figure 7:
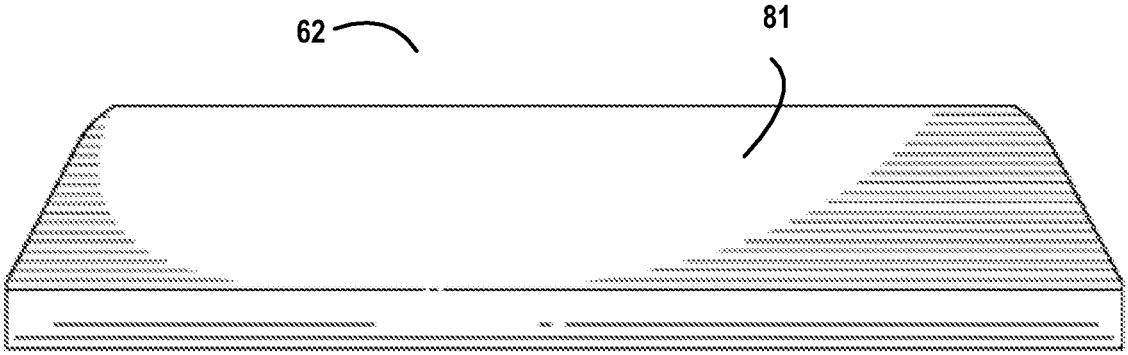
FIG. 7 is rear view of the retainer member of FIG. 5A.
Figure 8:
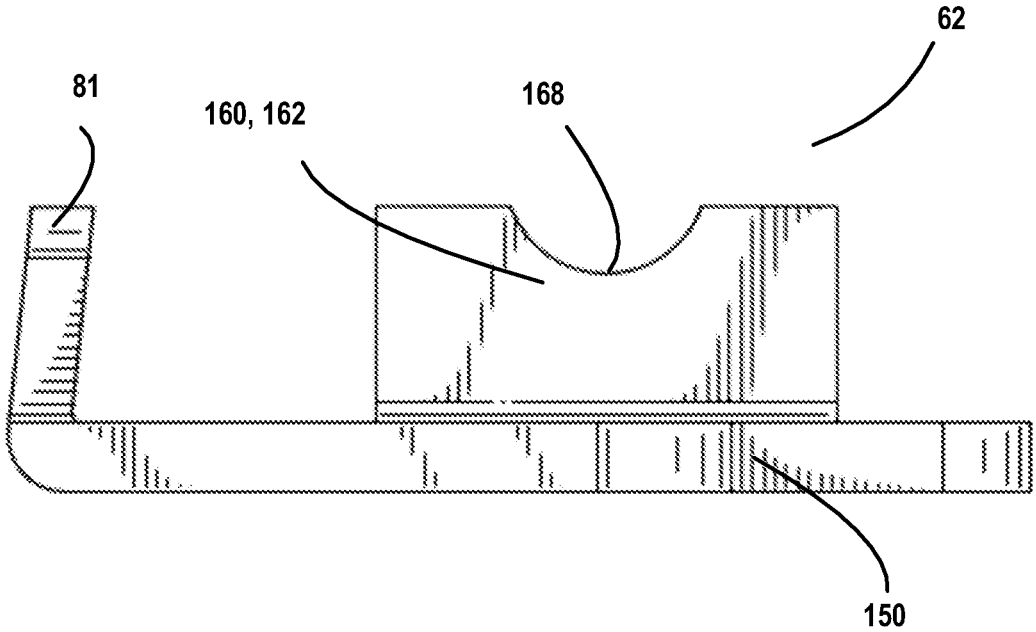
FIG. 8 is first side view of the retainer member of FIG. 5A.
Figure 9:
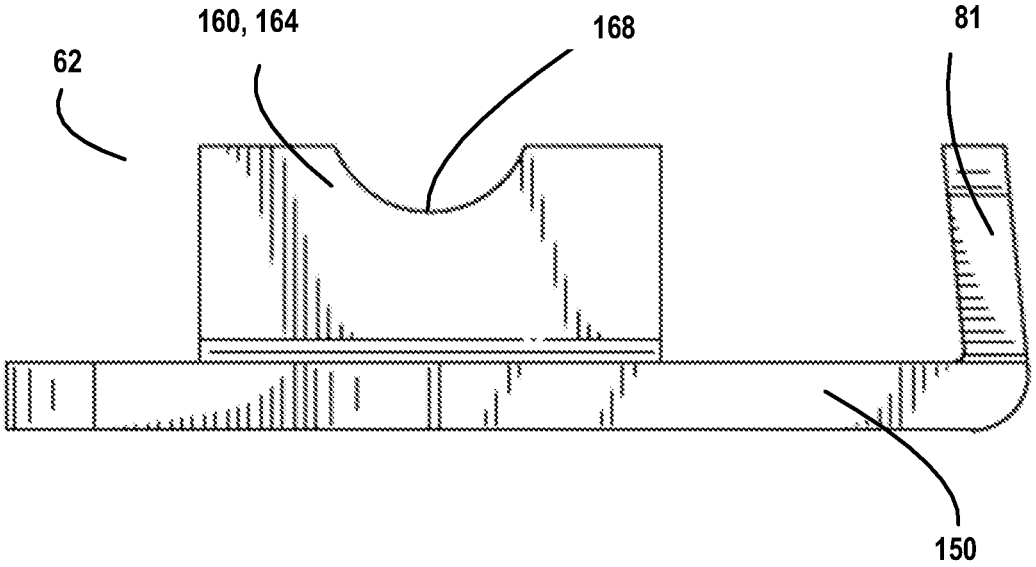
FIG. 9 is second side view of the retainer member of FIG. 5A.
Figure 10:
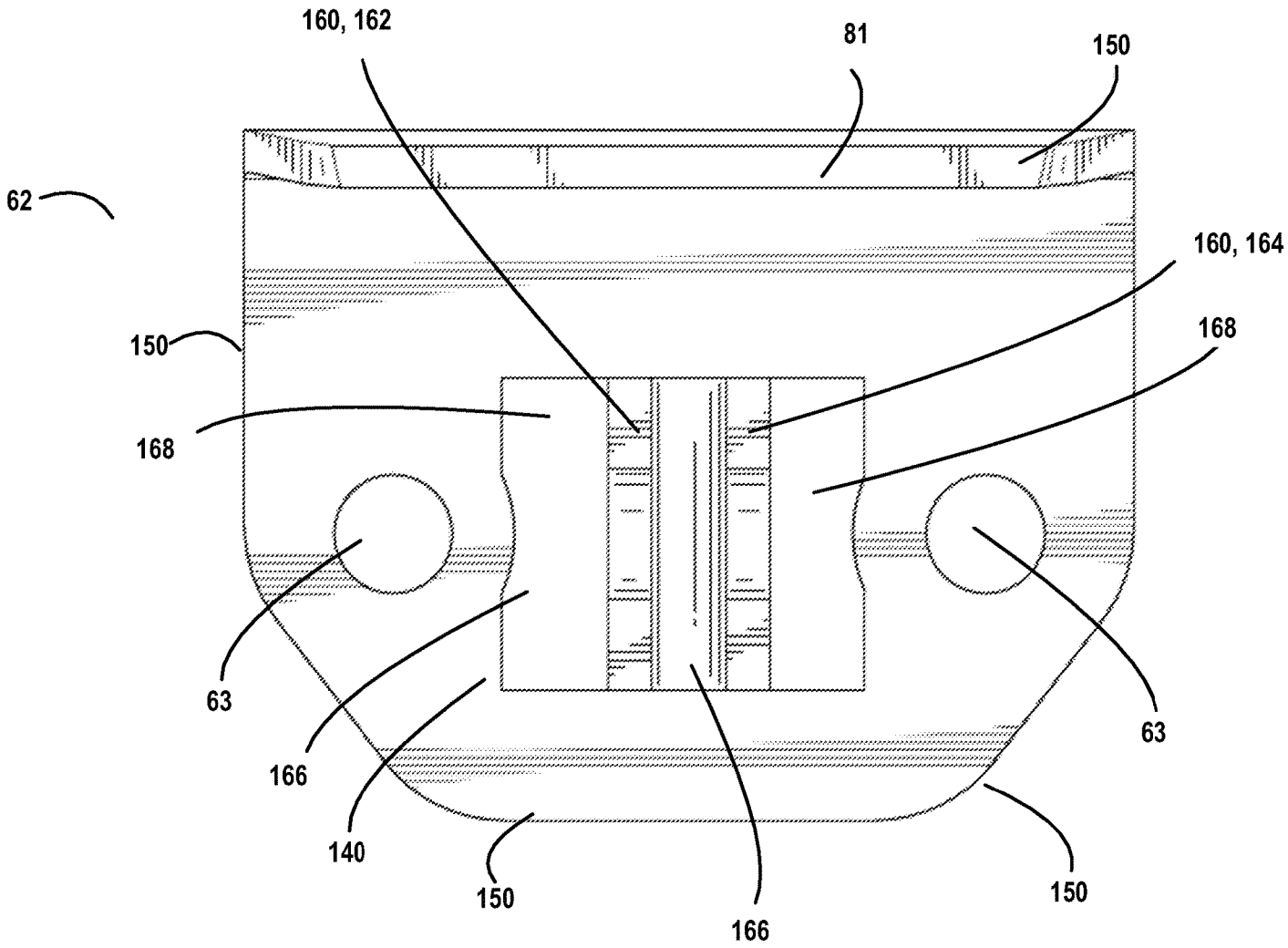
FIG. 10 is top view of the retainer member of FIG. 5A.
Figure 11:
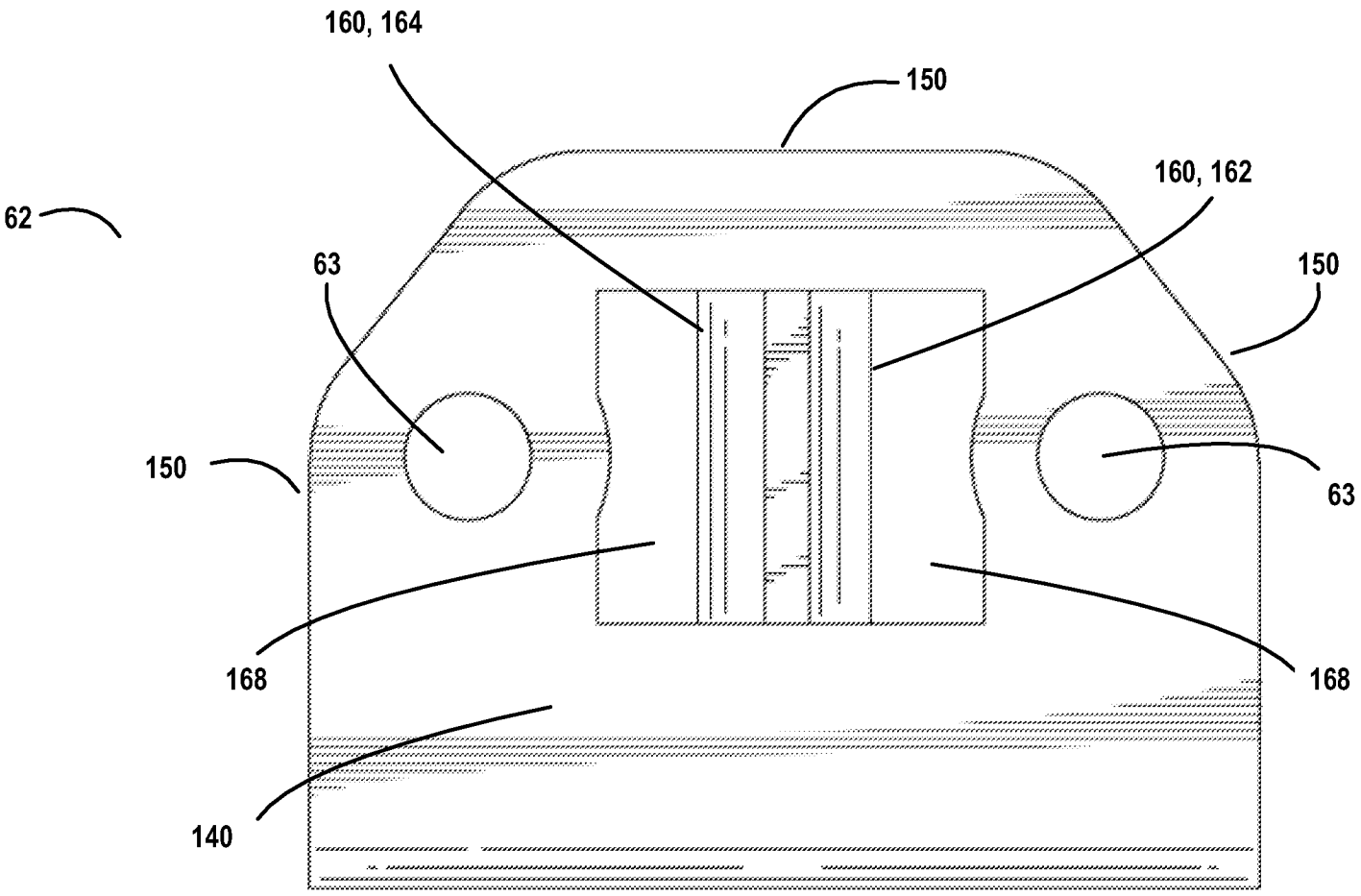
FIG. 11 is bottom view of the retainer member of FIG. 5A.

In some embodiments, the wall brace system 50 provides an apparatus for supporting a wall 52 in a building, which has been moved inward by pressure from the earth outside in order to return the wall 52 to a desired different position (e.g., its original position, or another position different than its current position). The wall brace system 50 comprises a structural member 60 (otherwise described as a "support member"), a retainer member 62 (e.g., a bottom retainer, such as a bottom retainer plate, or the like), a mounting member, which in some embodiments may be a mounting assembly 64 (e.g., mounting plate assembly, such as a joist mounting plate assembly, or the like), and/or a load member 66 (e.g., load plate, or the like). The structural member 60 can be any type of beam, such as an I-beam as shown in the figures, an H-beam, a C-channel beam, a beam of any shape (e.g., circular, oval, rectangular, square, triangular, or the like) that is solid or hollow, a flat rigid plate or any other such member. The structural member 60 may be made out of any type of material, such as steel, a composite, or another material. The structural member 60 is configured to be seated vertically against the inner surface of the wall 52 where pressure can be directed through the structural member 60 toward the wall 52, as illustrated in FIGS. 1 and 3. The structural member 60 may have a first end (e.g., lower end) that is configured for installation (e.g., mounting, or the like) adjacent a first portion of the wall (e.g., near the bottom of the wall, or other portion of the wall that requires support), and a second end (e.g., upper end) that is configured for installing (e.g., mounting, or the like) adjacent a second portion of the wall (e.g., near the top of the wall, or other portion of the wall that requires support). The retainer member 62 (i.e., bottom retainer) may be operatively coupled to (e.g., mounted to, or the like) a basement floor member, such as the floor 54, foundation 53, or another basement floor member (not illustrated). A portion of the lower end of the structural member 60 may be operatively coupled (e.g., secured, or the like) to the retainer member 62 and placed against the wall 52, as illustrated in FIG. 4. The structural member 60 extends upwardly away from the basement floor member, such as the floor 54, foundation 53, or another basement floor member.

As shown in FIGS. 1-3, the mounting member 64 is configured to operatively couple (e.g., rigidly secure, or the like) the upper end of the structural member 60 to a structural building member, such as a joist 58, building floor (e.g., above the basement floor 54), and/or vertical structural member (e.g., between the basement floor 54 or member thereof and the building floor or member thereof) in order to resist (e.g., prevent, reduce, or the like) movement of the upper end of the structural member 60. The upper end of the structural member 60 and the mounting member 64 may be spaced apart from each other. In some embodiments, a load member 66 is operatively coupled to the structural member 60, such as interfaces with a surface of the structural member 60, fits over the structural member 60, wraps around a portion of the structural member 60 (e.g., around a flange and/or web of an I-beam, or the like), fits within a channel of the structural member 60 (e.g., within a c-shaped channel, or the like), or the like. A jack 70 and/or locking member 72 operatively couple (e.g., are interposed between, or the like) the mounting member and the structural member 60, as illustrated in FIG. 1. As will described below, the jack 70, which may be a hydraulic jack, pneumatic jack, electric jack, and/or other type of powered or manual jack, functions to exert a force (e.g., a horizontally-directed force, or the like) against the structural member 60, directly or through a load member 66, in order to force the structural member 60 toward the wall 52 for shifting the wall (e.g., outwardly). As will be further described below, the locking member 72, which may be a fastener (e.g., bolt, screw, rod, pin, and/or nut, or the like), functions to lock the structural member 60 in place with respect to the mounting member (e.g., mounting assembly 64) after the jack 70 positions the structural member 60 (e.g., biases the beam towards the wall, or the like). In some embodiments the jack 70 may be used to move the locking member 72 to position the beam 60 (e.g., turn the locking member 72, or the like).

As shown in the drawings, in some embodiments of the present disclosure, the structural member 60 may be a beam formed in an "I"-shape (I-beam) having an outer flange 74 and an inner flange 76 connected by a web 78 (e.g., at the midsections of the flanges). It is understood, as discussed herein, that the structural member 60 could be another structural member of suitably sturdy construction, which can resist a bending force applied to it. Suitable substitutes may include, but are not limited to, structural members 60 that include channels, round or square tubes, or other shapes of any material, dimensional lumber (4×4, 4×6, etc.), composite beams, or any other structural members 60.

Referring to FIGS. 5A-11, in some embodiments of the present disclosure, the retainer member 62 has one or more apertures, such as holes 63 (e.g., a pair of holes, or the like), slotted holes (not illustrated), slots with an open end (not illustrated), or the like, formed for receiving fasteners (e.g., bolts, screws, rivets, spikes, or other like fasteners). It should be understood that the apertures may be enclosed (e.g., circular) or open (e.g., slotted and open on one end). The retainer member 62 is configured for operative coupling (e.g., attachment, or the like) to a structure, such as the floor 54, foundation 53, or the like support adjacent the base of the wall 52 by inserting a pair of fasteners through the apertures (e.g., holes 63, or the like) in the bottom retainer 62 and into the structure, such as the floor 54, foundation 53, or the like support. In one arrangement, floor apertures are preformed (e.g., predrilled, or the like) into the floor 54 and cement poured therein. When fasteners (e.g., threaded bolts, ribbed rods, or the like fasteners) are inserted, the cement dries around the fasteners (e.g., around the threads, ribs, or the like), resulting in long-lasting holding power. In this embodiment, the apertures of the retainer member 62 receive the fasteners embedded into the structure (e.g., floor 54) and a not or other fastener component operatively couples the retainer member 62 to the fasteners.

It should be understood that the retainer member 62 may be made of any size and shape. For example, the retainer member 62 may be sized to allow the apertures (e.g., holes 63, or the like) of the retainer member 62 to be positioned directly next to the first end of the structural member 60 (e.g., as illustrated in FIGS. 1-3). However, it should be understood that the retainer member 62 may be sized to allow the holes 63 to be positioned farther away from the structural member 60. For example, the retainer member 62 may extend past the structural member 60 and away from a wall (e.g., when installed), in order to allow the fasteners to be operatively coupled the retainer member 62 away from the wall 52 and the structural member 62. Such a location away from the conversion of the wall and floor may provide an improved location for securing the retainer member 62 to a structure, such as the floor 54, or other support, either structurally or due to ease of installation.

The retainer member 62 may comprise one or more retainer stops, such as one or more flanges 81, or the like, which may be operatively coupled to the retainer member 62. For example, one or more flanges 81 may be formed by bending edges 150 of the retainer member 62. In other examples, the one or more flanges 81 may be welded to the retainer body 140, coupled using fasteners, or the like. In some embodiments the retainer member 62 may have one or more tabs 160, such as a first tab 162 and a second tab 164. It should be understood that the one or more tabs 160 may be formed from the retainer body 140 of the retainer member 62. For example, as illustrated in FIGS. 5A-11, the one or more tabs 160 may be cut from the retainer body 140 and bent into position to form a retainer tab cavity 166 that is configured for receiving a portion of the structural member 60 described herein. It should be understood that the one or more tabs 160 may formed from the retainer body 140 within the edges 150 of the retainer body 140 (as illustrated in FIGS. 5-11). However, in other embodiments, the one or more tabs 160 may formed within the retainer body 140 and extend through the edges 150 of the retainer body 150. However, it should be understood by forming the one or more tabs 160 from the retainer body 140 within the edges 150 of the retainer member 62 may provide improved strength of the retainer member 62 because the retainer member 62 maintains a larger unitary retainer body 140.

The one or more tabs 160 may be made of any shape and size, such as, but not limited to square, rectangular, semi-circular, oval, crescent, triangular, polygonal, or other uniform or non-uniform shape, or combinations thereof. The first retainer tab 162 and the second retainer tab 164 forming the tab cavity 166 may have a generally U-shaped cross-section. As illustrated in FIGS. 5A-11, the one or more tabs 160 may be generally rectangular and have a concave surface 168 on at least a portion of the or more tabs 160. The concave surface 168 may serve the purpose of allowing additional material to be maintained in the retainer body 140 adjacent the retainer apertures (e.g., holes 63, or the like) for the fasteners (e.g., to aid in reducing deformation the retainer body 140 around the apertures). Moreover, the concave surface 168 (or other cut-out within the tabs) may allow for retainer member 62 to maintain a reduced envelope (e.g., size) while supporting the structural member 60.

As will be described in further detail herein with respect to FIG. 12, the retainer member 62 may be formed in a number of ways, but in general. the retainer tabs are partially separated from the retainer body 140 and bent into a position in which the first retainer tab 162 and the second retainer tab 164 form a retainer tab cavity 166 that is conferred to receive a portion of the structural member 60 of the wall brace system 50.

As seen in FIGS. 1-3, in some embodiments, the cavity 166 is sized for receiving a web 78 of the beam 60 inserted between the upright first retainer tab 162 and the second retainer tab 164 when the beam 60 is placed on the retainer member 62 (e.g., after the retainer member is installed) and positioned against the wall 52. The first retainer tab 162 and the second retainer tab 164 may resist side-to-side movement (e.g., in plane with the wall 52) of the beam 60. However, in some embodiments the first retainer tab 162 and the second retainer tab 164 may allow slippage towards and away from the wall 52. As such, it should be understood that the one or more retainer stops (e.g., flanges 81), may be utilized to stabilize the beam 60 adjacent the wall 52, that is, aid in preventing movement (e.g., perpendicular to the wall 52) of the beam 60 through contact with an inner flange 76 of the beam 60. It should be understood that while the retainer member 62 is illustrated for use with an I-beam, the one or more tabs 160 may be positioned, sized, and shaped for use with other types of beams 60, such as but not limited to a H-beam or a C-channel beam (e.g., tabs may be located in different orientations, or the like) or a circular, oval, square, triangular, rectangular beam (e.g., beam may fit within and/or over tabs, or the like), or other like beam.

In some embodiments of the present disclosure, the retainer member 62 may also have one or more channels (not illustrated), such that water may be able to pass under the retainer 62 and/or structural member 60. Since the wall brace 50 system is often installed in areas that are prone to accumulate water, the one or more channels in the retainer member 62 may be utilized in order to allow water to pass under or through at least a portion of the retainer member 62, thus reducing or preventing the pooling of water around the retainer member 62, which may reduce or prevent damage to the retainer member 62 and/or the structural member 60 over time. It should be understood that the one or more channels may be formed of any shape (e.g., rectangular, circular, square, or any other uniform or non-uniform shape).

Returning to FIGS. 1-3, the mounting member may be a bracket that is operatively coupled to a building structural member, and is used to support a jack 70 and/or a locking member 72 in order to allow for adjustment of the position of the bream 60 as the jack 70 is operated. In some embodiments, the mounting member may be a mounting assembly 64 comprising a base plate 82, an S-shaped bracket 84, and a cross brace 86. The base plate 82 may have a pair of holes 83 formed in opposite corners to receive fasteners (e.g., bolts, or the like) for securing the mounting assembly 64 to a building member (e.g., the floor joist 58, or the like); however, it should be understood that any number of holes 83 and/or fasteners may be utilized in any pattern. The base plate 82 may be mounted to the floor joist 58 by a pair of conventional bolts extending through the holes 83 and into the floor joist 58. One or more washers, such as a single elongated washer may slide onto the bolts prior to being secured with nuts. The base plate 82 is thus fixed in place in such a way that the mounting assembly 64 can support substantial forces.

The mounting assembly 64 may further comprise a jack bracket 84 (e.g., an S-shaped steel plate, or the like) operatively coupled (e.g., welded, or the like) to the base plate 82. The locking member 72, such as a bolt, may extend through a hole in a portion of the bracket 84 (e.g., through one leg) for applying a force to the beam 60. A nut 90 is threaded onto the bolt 72. In some embodiments the outer end of the locking member 72 may seat against a surface of the beam 60 directly, against a locking interface (e.g., socket located on the beam), against a load member 66 (e.g., on a surface of the load plate, or within a locking interface on the load plate), thus engaging the upper end of the beam 60.

The jack 70 may be placed in a supporting cradle comprising alignment guides operatively coupled (e.g., welded, or the like) to the mounting assembly 64 (e.g., leg of the bracket 84). For example, in some embodiments a first end of the jack 70 seats against a leg of the bracket 84, and the other end of the jack 70 seats against the beam 60 directly, a load plate 66 on the beam 60, or the like. The jack 70 is configured to expand and retract between the mounting assembly (e.g., the bracket 84) and the beam 60 (e.g., directly or through a load member 66). Additionally, or alternatively, the jack 70, such as the hydraulic jack, may installed through an aperture in the mounting assembly 64 (e.g., within the bracket 84, or the like).

The structure of the mounting member (e.g., the mounting assembly 64, or the like), and the manner in which the mounting member is operatively coupled (e.g., mounted, or the like) adjacent the wall 52, may vary according to the circumstances encountered in any given situation. For example, the joists 58 may run parallel to the wall, and/or the mounting member may be required to be installed in a different orientation. As such, it should be understood that the mounting member may be configured differently from the mounting assembly 64 illustrated in FIGS. 1-3. Consequently, it should be understood that the structure of the mounting member may include one or more plates 82, brackets 84, and/or cross-braces 86 in different orientations as needed to operatively couple the mounting assembly 64 to one or more building members.

It is understood that the distance between beam 60 and at least a portion of the mounting member, such as the bracket 84, is to be spaced large enough to accommodate the later installation and/or removal of the jack 70 therebetween, yet small enough so that the jack 70 has substantial travel available after installation in order to move the beam 60 to the desired location. In this way, the mounting member may be operatively coupled to a building member in a location to provide the desired space. Alternatively, in some embodiments of the invention, a portion of the mounting member (e.g., base plate 82, or the like) may remain stationary with respect to the building member, while another portion of the mounting member (e.g., bracket 84, or the like) may be adjustable and/or replaceable in order to adjust the travel space to account for different spaces of travel of the jack 70.

In some embodiments of the invention, one end of the jack 70 is supported by the bracket 84 with an extendable shaft 71 oriented along a horizontal axis. In the case of a hydraulic jack, the jack 70 may receive hydraulic fluid through a controllable valve. Pressure fluid is admitted to or exhausted from the jack 70 by means of a hydraulic hose connecting with the valve. As is understood, hydraulic jack cylinders provide for an enclosed chamber that may be pressurized with a hydraulic fluid to apply force to an axially extendable and retractable shaft communicating with the enclosed chamber through a piston sealably slidable in the cylinder. Thus, the jack 70 can be actuated to extend the shaft toward the beam 60 and force the wall 52 toward the vertical position under hydraulic pressure. The locking member 72, extends in a direction parallel to the shaft of the jack 70, such as a threaded locking rod that is adjustable. The locking member 72 is used to engage the beam 60 at the position to which the jack 70 has moved the beam 60. The locking member 72 functions to hold the position of the beam 60 and the wall 52 as achieved by the pressure of the jack 70. It is understood that while the jack 70 is described as a hydraulic jack, as discussed herein, it can be replaced with, a pneumatic jack, electric jacks (e.g., screw jack, or the like), or other like jacks, and as such any type of jack 70 having characteristics similar the hydraulic jack may be used.

Referring to FIGS. 1-4, in some embodiments, the load member 66 may be a load plate that comprises a generally C-shaped pad having side flanges 96 connected to a web 97 which fits slidably over an inner flange 76 of the beam 60. The web 97 may be of a width which is just greater than that of the inner flange 76 of the beam 60 so that the web 97 of the load plate 66 extends laterally across and adjacent the inner flange 76 and the load plate flanges 96 may extend past the side edges of the inner flange 76. In use, the shaft 71 of the jack 70 is forced against the web 97 of the load plate 66 which, in turn, is forced against the inner flange 76 of the beam 60. Thus, the force load delivered by the jack 70 is transferred to the outer flange 74 of the beam 60 through both of the webs 78, 97.

In some embodiments, spaced interfaces, such as vertically spaced sockets 98, 100 (e.g., circular sockets as illustrated in FIG. 4) are mounted directly to the inner flange 76, or the inner surface of the load plate 66 along a central longitudinal axis. The sockets 98, 100 extend axially inwardly and are configured to receive the outer ends of the jack 70 and the locking member 72, respectively. The sockets 98, 100 are preferably metal, but can be made of any material that has sufficient strength, including composite or plastic. The sockets 98, 100 are mounted to the load member 66, or in other embodiments directly to the beam 60, using suitable means, such as welding, adhering, or the like, or the sockets 98, 100 are formed integral with the beam 60. It should be understood that the sockets 98, 100 are strong enough to resist fracture under the loading of the jack 70 and/or other forces imparted by the locking member 72. The sockets 98, 100 may be any type of shape to facilitate operative coupling with a portion of the jack 70 and/or locking member 72. In some embodiments, the inner diameters of the sockets 98, 100 are at least slightly greater than the outer diameter of the shaft 71 of the jack 70 and the locking member 72, which are free to move within the sockets 98, 100 (e.g., in and out of the sockets). However, the sockets 98, 100 may be any shape and size, and in some embodiments may be slotted, or otherwise allow for movement between the structural member 60 and/or load member 66, and the jack 70 and/or locking member 72, as the wall brace system 50 is being installed. The sockets 98, 100 enable the shaft 71 of the jack 70 and the locking member 72 to seat securely against the load plate 66.

FIG. 12 illustrates a process 200 of forming the retainer member 62 and installing the retainer member 62 with the wall brace system. As illustrated by block 210 of FIG. 12 the retainer body 140 of the retainer member 62 is formed. For example, the retainer body 140 may be cut (e.g., stamped, punched, sheared, separated, remove a portion of, or the like) from a material (e.g., steel sheet, plate, or the like). For example, in some embodiment the retainer body 140 may be cut using a laser or fluid cutting process. In another example, the retainer body 140 may be cut using a stamping process. In some embodiments, the retainer body 140 may be formed in a molding process (e.g., cast, die, or the like). In other embodiments, the retainer body 140 may be extruded. However, it should be understood that the retainer body 140 may be formed using various types of manufacturing processes.

Block 220 of FIG. 12 illustrates that the one or more tabs 160 may be formed from the retainer body 140. In some embodiments the one or more tabs 160 may be formed after the retainer body 140 is formed, during the formation of the retainer body 140, and/or before the formation of the retainer body 140. In some embodiments, the one or more tabs 160 may be formed (e.g., cut, molded, or the like) during the formation of the retainer body 140. In other embodiments, the one or more tabs 160 may be cut before or after the retainer body 140 is formed. For example, the outline of the one or more tabs 160 may be cut into the retainer body 140, but still lay in the same plane as the retainer body 140. As previously discussed, the one or more tabs 160 may be cut such that the cut extends through an edge 150 of the retainer body 140. Alternatively, as previously discussed, the one or more tabs 160 may located within the edges 150 of the retainer body 140.

FIG. 12 further illustrates in block 230 that the one or more tabs 160 are bent into position. For example, the one or more tabs 160 may be bent from within the interior of the retainer body 140 and/or from the edges 150 of the retainer body 140. In some embodiments, the one or more tabs 160 are bent to be approximately perpendicular to the plane of the retainer body 140 (e.g., within 1, 2, 3, 4, 5, 8, 10, 15, or the degrees of perpendicular). In some embodiments, the one or more tabs 160 may be bent into position (e.g., approximately perpendicular, or the like) after the retainer body 140 is formed. In some embodiments, the one or more tabs 160 may be formed such that they are bent into position (e.g., approximately perpendicular, or the like) when the retainer body 140 and/or the one or more tabs 160 are formed, such as during a stamping process.

Block 240 in FIG. 12 further illustrates that a retainer stop (e.g., flange 81, or the like) is formed in the retainer body 140. Like the one or more tabs 160, the retainer stop may be bent approximately perpendicular to the plane of the retainer body 140 after the retainer body 140 is formed. Alternatively, the retainer stop may be formed when the retainer body 140 and/or the one or more tabs 160 are formed, such as during a stamping process.

FIG. 12 illustrates in block 250 that the retainer apertures 63 are formed in the retainer body. Like the one or more tabs 160, the retainer apertures 63 may be formed after the retainer body 140 is formed. Alternatively, the retainer apertures 63 may be formed when the retainer body 140 and/or the one or more tabs 160 are formed. For example, the one or more retainer apertures 63 may be cut (e.g., stamped, punched, drilled, or the like).

Block 260 illustrates that once the retainer member 62 is formed, the retainer member 62 may be used and installed as a part of the wall brace system 50 described herein. For example, the retainer member 62 is operatively coupled adjacent a first portion of the wall 52 (e.g., near the bottom of the wall). For example, the bottom retainer member 62 may be operatively coupled (e.g., mounted) to a floor member structure (e.g., floor 54, foundation 53, or other basement floor member). In some embodiments, one or more fasteners may be used to operatively couple the retainer member 62 to adjacent a first portion of the wall 52 (e.g., to the floor member) through the one or more retainer members 63 in the retainer body 140.

Once the retainer member 62 is secured in place, the structural member 60 (e.g., beam) is operatively coupled to the retainer member 62, for example, placed in the retainer member 62 such that a web 78 of an I-beam is received in the retainer cavity 166 between the upwardly extending tabs 162, 164. The one or more retainer flanges 81 and the one or more tabs 162 restrict movement of the lower end of the structural member 60 away from (e.g., the retainer flange 81) and/or parallel with the wall 52 (e.g., the one or more tabs 162). The structural member 60 may be seated as vertically as possible against the wall 52. At the upper end, the structural member 60 is typically spaced from the wall 52 an amount determined by the bowing of the wall.

Additionally, the mounting member is operatively coupled to a building member, such as a floor joist 58, spaced inwardly from the upper end of the structural member 60, as described herein. The jack 70 and/or the locking member 72 are operatively coupled to the mounting member, such as the mounting assembly 64, and/or the structural member 60, directly or indirectly, through a load member 66 (e.g., interposed between the bracket 84 and the beam 60). It should be understood that the jack 70 and/or locking member 72 may be installed together, or at separate times (e.g., the jack 70 may be installed before the locking member 72, or vice versa). In some embodiments the locking member 72 may be installed after the jack 70 positions the structural member.

The jack 70 is extended, for example, the shaft 71 of the jack 70 is extended and exerts outwardly directed forces against the structural member 60, directly or through the load member 66, toward the wall 52 for moving and supporting the wall 52. For example, the load member 66 transmits the force of the jack 70 to the inner flange 76 of the structural member 60, and thus, to the outer flange 74 through the web 78 of the structural member 60 so that the outer flange 74 of the structural member 60 is urged against the wall 52 exerting force on the wall 52 until the wall 52 has been pushed back into position. The jack 70 may allow the installer to measure the amount of force applied to the structural member 60, and thus, the wall. The measurement of the force may also be used to allow an installer to recheck the wall brace system 50 in the future, and to readjust the force being applied (e.g., add more force or reduce the force).

When the wall 52 reaches its desired position, the structural member 60 is secured by the locking member 72 so as to prevent the wall 52 from moving inwardly. As described herein, the locking member 72 may comprise a locking rod that extends from the mounting member, such as the mounting assembly 64, and applies a force to the structural member 60. In some embodiments the locking member 72 is threaded, and as such, the locking member 72 is rotated until the outer end seats against the structural member 60 and/or the load member 66, such as in the socket 100 against the surface of the load member 66. Upon further tightening of the locking member 72, the locking member 72 will apply a force against the upper end of the structural member 60 that increases as the locking member 72 is rotated further. The actuation of the locking member 66 secures the structural member 60 in position so that the wall 52 is held in place with the locking member 66. For example, once the locking member 72 is tightened to the desired force, a nut 73 may be threaded against the mounting member, such as the mounting assembly 64 (e.g., the bracket 84), for securing the locking member 72 in position.

The jack 70 is removed from the mounting member, such as the mounting assembly 64, after the locking member 72 is positioned. The jack 70 may then be operatively coupled to other mounting members, such as the mounting assemblies 64, having other locking members 72 in order to install and/or adjust the structural members 60 of other wall brace systems 50. Moreover, over time, the jack 70 may be operatively coupled to the same mounting member, such as the mounting assembly 64, to adjust the position of the structural member 60 and/or the locking member 72, as the wall 52 and/or structural member 72 requires movement over time.

It should be understood that the steps described with respect to FIG. 12, and elsewhere within this disclosure, may occur in any order.

The present disclosure generally describes installing a single wall brace system 50, using a single jack 70 to position the structural member 60 of the wall brace system 50, and thereafter, installing another wall brace system 50 and/or using the jack 70 on a separate structural member 60 that is partially installed (e.g., installed but not yet loaded to position the structural member 60, or the like). However, it should be understood that multiple jacks 70 may be utilized at one time to install multiple structural members 60 within one or more wall brace systems 50 (e.g., the wall brace system 50 may be used to describe the installation of a single structural member 60 and associated components or multiple structural members 60 and associated components). For example, in some embodiments two or more wall brace systems 50 (as part of a larger wall support system) may be partially installed (e.g., without using a jack 70 for applying pressure to the individual structural member 60). Two or more jacks 70 may be installed to the two or more wall brace systems 50 (e.g., as each system is being installed or after the systems are installed). The two or more jacks 70 may be operatively coupled to each other (e.g., through a manifold, mechanical control members, software control features, or the like), which allows an installer to operate the two or more jacks 70 at the same time. Consequently, in these embodiments, the multiple jacks 70 may be connected in series and loaded together in order to allow for loading of multiple structural members 60 within the two or more wall brace systems 50 at the same time. It should be further understood that while multiple jacks 70 may be used at the same time, the jacks 70 may apply the same force or different forces to the two or more structural members 60 (e.g., depending on how severely a wall is bowed at the position of each of the structural members 60). In this way, the multiple jacks 70 may be utilized to quickly install the system by applying forces to the structural members 60, and thus, the entire wall (or multiple walls) at the same time. It should be understood that in other embodiments, one or more installers may operate the multiple jacks 70 (e.g., coupled jacks 70 or uncoupled jacks 70) individually to apply the forces to the wall in different locations, as needed.

It should be further understood that the jack 70 and/or locking member 72 may be operatively coupled to the mounting member, such as the mounting assembly 64, in different orientations; however, typically they will be installed in a vertical orientation with respect to each other (e.g., with the jack 70 vertically above the locking member 72, or the locking member 72 above the jack 70). As such, it should be understood that should the structural member 60 be located in a different orientation from vertical (e.g., at an angle), the mounting member, such as the mounting assembly 64, may be installed in the same plane to allow the jack 70 and locking member 72 to be installed in the same plane as the structural member 60.

It should be further understood that in some embodiments of the invention, the locking member 72 may be located in-line with the jack 70. That is, the locking member 72 and the jack 70 may be operatively coupled to the mounting member, such as the mounting assembly 64, in-line longitudinally with each other, or otherwise, in a configuration in which the jack 70 is activated to move the locking member 72, which interacts with the structural member 60 (e.g., directly or through the use of the load member 66) to position the structural member 60. That is, the jack 70 engages to the structural member 60 through the use of the locking member 72 itself, and when the structural member 60 is in the desired location, the locking member 72 is locked into place, and the jack 70 is removed from the mounting member, such as the mounting assembly 64.

In other embodiments of the invention, there may be two or more mounting members (e.g., mounting assemblies), such as a jack mounting assembly and a locking member mounting assembly. In this way, both mounting assemblies may be operatively coupled to a building member. The jack 70 may be further operatively coupled to the jack mounting assembly, and the locking member 72 may be operatively coupled to the locking member mounting assembly. In this way, the jack 70 and the locking member 72 may be located at different locations, should it be required based on the configurations of the building members (e.g., joists, or other structural members), installation preferences, and/or as necessary to apply the load to the structural member 60.

In some embodiments of the present disclosure the wall brace system 50 may include a gauge that is operatively coupled to a locking member 72 (or the jack 70 if the jack remains in place), in order to allow an installer to determine how much force is being applied to the wall (or otherwise stated how much force the system—the locking member 72 or the like—is under). It should be understood that the wall brace system 50 disclosed herein functions as a "force-applying device" to apply an outward force to the foundation wall 52. The jack 70 of the present disclosure exerts a significant outwardly directed force against the beam 60, thereby tending to straighten the wall 52. The jack 70 forces the beam 60, and in turn wall 52, outward to the proper position since the beam 60 ends are secured against movement.

The present invention provides improvements to retainer members 62, and in particular, to retainer members 62 for wall brace systems 50. For example, the present invention allows for the creation of a retainer member 62 out of a unitary retainer body 140, without the need for operatively coupling additional flanges (e.g., clips welded, fastened, or the like to the retainer body 140), which requires additional connections that may create points of potential failure (e.g., bad welds, defective fasteners, or the like). Moreover, the retainer members 62 described herein may be formed more efficiently (e.g., quickly, less resources, less waste, less energy, less material, or the like), while providing the same or improved strength over traditional retainers.

To supplement the present disclosure, this application incorporates by references in its entirety U.S. Pat. No. 11,142,920.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together. Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more." Certain terminology is used herein for convenience only and is not to be taken as a limiting. For example, words such as "upper," "lower," "horizontal," "vertical," "upward," "downward," "top" and "bottom", or the like merely describes the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A retainer member comprising:

a retainer body, wherein the retainer body is at least partially located in a body plane;

a first retainer tab formed from the retainer body; and a second retainer tab formed from the retainer body;

wherein the first retainer tab and the second retainer tab are cut from within the retainer body and bent to extend away from the body plane;

wherein the first retainer tab and the second retainer tab form a cavity having a U-shaped cross-section;

wherein the first retainer tab and the second retainer tab have a cut-out within an edge of the first retainer tab and the second retainer tab to maintain additional material in the retainer body for reducing deformation of the retainer body; and wherein the first retainer tab and the second retainer tab are configured to receive a portion of a structural member in the cavity to aid in restricting movement of the structural member.

2. The retainer member of claim 1, wherein the first retainer tab and the second retainer tab are cut and bent to extend away from the body plane during a single process.

3. The retainer member of claim 1, wherein the retainer body is cut to form the first retainer tab and the second retainer tab within the body plane and thereafter bent to extend the first retainer tab and the second retainer tab away from the retainer body.

4. The retainer member of claim 1, wherein the retainer body or at least one of the first retainer tab and the second retainer tab comprise an aperture to allow a tool to bend the first retainer tab and the second retainer tab.

5. The retainer member of claim 1, further comprising:

a retainer stop, wherein the retainer stop is configured to restrict movement of the structural member within the cavity.

6. The retainer member of claim 5, wherein the retainer stop is a retainer flange formed from an edge of the retainer body, and extending away from the body plane.

7. The retainer member of claim 1, wherein the retainer body, the first retainer tab, and the second retainer tab are made from a unitary piece of material.

8. The retainer member of claim 1, wherein the first retainer tab and the second retainer tab are formed from within outer edges of the retainer body.

9. A wall bracing system, the system comprising:

a retainer member, wherein the retainer member is operatively coupled adjacent to a wall, and wherein the retainer member comprises:

a retainer body, wherein the retainer body is at least partially located in a body plane;

a first retainer tab formed from the retainer body; and a second retainer tab formed from the retainer body;

wherein the first retainer tab and the second retainer tab are cut from within the retainer body and bent to extend away from the body plane, and wherein the first retainer tab and the second retainer tab form a cavity having a U-shaped cross-section;

a mounting member, wherein the mounting member is operatively coupled to a building member;

a structural member having a first end and a second end, wherein the first end is operatively coupled to the retainer member within the cavity between the first retainer tab and the second retainer tab, and wherein the second end is operatively coupled to the mounting member; and a locking member operatively coupled to the mounting member, wherein the locking member is configured to resist movement of the structural member.

10. The system of claim 9, further comprising:

a jack configured to be operatively coupled to the mounting member, wherein at least a portion of the jack is removable while the locking member remains operatively coupled to the mounting member and the structural member.

11. The system of claim 10, wherein the jack is a hydraulic jack, pneumatic jack, or electric jack.

12. The system of claim 10, wherein the mounting member comprise a mounting assembly comprising:

a base plate that is operatively coupled to the building member; and one or more support brackets operatively coupled to the base plate;

wherein the one or more support brackets are configured to be operatively coupled with the jack or the locking member.

13. The system of claim 9, further comprising:

a load member operatively coupled between the structural member and the locking member.

14. The system of claim 9, wherein the first retainer tab and the second retainer tab are cut and bent to extend away from the body plane.

15. The system of claim 9, wherein the retainer member further comprises:

a retainer stop, wherein the retainer stop is configured to restrict movement of the structural member within the cavity.

16. The system of claim 9, wherein the retainer body, the first retainer tab, and the second retainer tab are made from a unitary piece of material.

17. The system of claim 9, wherein the first retainer tab and the second retainer tab have a cut-out within an edge of the first retainer tab and the second retainer tab to maintain additional material in the retainer body for reducing deformation of the retainer body.

18. The system of claim 9, wherein the first retainer tab and the second retainer tab are formed from within outer edges of the retainer body.

19. A method for forming a retaining member, the method comprises:

forming a first retainer tab and a second retainer tab from a retainer body by cutting the first retainer tab and the second retainer tab from within the retainer body;

bending the first retainer tab and the second retainer tab such that the first retainer tab and the second retainer tab extend away from a body plane of the retainer body;

wherein the first retainer tab and the second retainer tab form a cavity having a U-shaped cross-section;

wherein the first retainer tab and the second retainer tab have a cut-out within an edge of the first retainer tab and the second retainer tab to maintain additional material in the retainer body for reducing deformation of the retainer body; and wherein the first retainer tab and the second retainer tab are configured to receive a portion of a structural member of a wall brace system between the first retainer tab and the second retainer tab to aid in restricting movement of the structural member.

* * * * *